US006286537B1

(12) United States Patent
Backham et al.

(10) Patent No.: US 6,286,537 B1
(45) Date of Patent: Sep. 11, 2001

(54) THERMALLY-ACTUATED SWITCH ASSEMBLY

(75) Inventors: Michael Backham, Canterbury; Kevin Munson, Whitstable; Alan Neal, Canterbury; Charles Shillitoe, Colchester, all of (GB)

(73) Assignee: Ruskin Air Management Limited (GB)

( * ) Notice: Subject to any disclaimer, the term of this patent is extended or adjusted under 35 U.S.C. 154(b) by 0 days.

(21) Appl. No.: 09/598,081

(22) Filed: Jun. 21, 2000

(51) Int. Cl.[7] ..... F16K 17/40

(52) U.S. Cl. ..... 137/79; 137/343; 251/68; 454/369

(58) Field of Search ..... 137/79, 343; 454/369; 251/68

(56) References Cited

U.S. PATENT DOCUMENTS 744,404 * 11/1903 Reno ..... 160/1
3,580,321 * 5/1971 Root ..... 160/1
5,533,929 * 7/1996 Attridge Jr. ..... 454/369
5,787,919 * 8/1998 Pyle ..... 137/79

* cited by examiner

*Primary Examiner*—A. Michael Chambers
(74) *Attorney, Agent, or Firm*—Akin, Gump, Strauss, Hauer & Feld, L.L.P.

(57) ABSTRACT

A thermally-actuated switch assembly is capable of controlling an associated device in the event of a sensed temperature exceeding a predetermined threshold. A first switch in the form of for example a fuse is used to sense the temperature to which the device is sensitive. The first switch is carried by a housing which also carries a second switch. The second switch is arranged such that it is actuated if the housing is mounted on a support in a predetermined orientation. The first and second switches are connected to an output and arranged such that the output indicates an alarm condition if either the first switch is actuated or the second switch is not actuated. Thus one switch is used to sense the temperature, and the other switch is used to sense whether or not the switch assembly as a whole is correctly positioned.

18 Claims, 2 Drawing Sheets

THERMALLY-ACTUATED SWITCH ASSEMBLY

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention relates to a thermally-actuated switch assembly, and in particular to such a switch assembly which may be used to control a damper in an air distribution duct.

2. Description of the Related Art

It is known to provide thermally-actuated dampers in ducts. For example, a damper may be fitted in a duct adjacent to a part of a duct system which penetrates a fire barrier or wall. Such dampers are arranged to close the duct in the event of temperatures within and/or outside the duct exceeding a pre-determined threshold. Dampers of this type are specified where it is necessary to ensure the integrity of the fire wall and thereby prevent the spread of a fire through a duct penetrating the fire wall. With such an arrangement the damper is normally open but closes in the event of an excess temperature being sensed. Other dampers are known which operate in the opposite sense, that is they are normally closed but open when exposed to an excess temperature. Such dampers may be used in situations where there is a requirement for providing a smoke vent which only opens in the event of a fire.

One known damper consists of a steel casing which is interconnected between two sections of a duct. The casing houses a number of interlocking steel blades which can be rotated through 90 degrees between a first position in which the blades are edge-on to the direction of the ducts and a second position in which the blades extend transversely with respect to the direction of the duct. In the first position the blades are spaced apart and air can flow between them. In the second position the blades overlap and form an effective barrier across the duct. Generally the blades are held in the first (open) position to allow air flow through the ducts. The damper blades are held in the open position by means of a spring return actuator. The actuator incorporates a motor which is mechanically coupled to a damper shaft rotation of which controls the position of the damper blades. When power is supplied to the actuator, the motor is energised and turns the damper blades to the open position. The motor as it rotates the blades to the open position also tensions a spring. Once the actuator has been fully reset so that the blades are in the open position, the motor stops and a mechanism holds the spring in its tensioned condition providing the supply of the electrical power to the actuator is maintained. If the supply of electrical power is cut off, the spring is released and the damper shaft is driven to a position in which the damper blades extend transversely relative to the ducts, that is the damper blades are in the closed position.

In the known damper a thermal fuse is incorporated in the electrical supply to the actuator, the thermal fuse being mounted on either the damper casing or one of the ducts connected to the damper casing. Generally the thermal fuse incorporates a single fuse element which is mounted on a probe that extends through an opening cut in the casing or duct. In some arrangements however two thermal fuses are provided, one mounted in use within the duct and one mounted external to the duct. If one of the fuses is exposed to a temperature in excess of a pre-determined limit the fuse assumes an open-circuit condition, thereby cutting off the electrical supply to the damper and causing it to move to a duct closed position.

The electrical supply to the damper may be cut off by other means, for example by switching power off at a control panel to which the fire service might have access, or a simple mains failure. The present invention is concerned however with situations in which a switch assembly incorporating for example a fuse is incorrectly positioned such that the fuse is not exposed to the environment the temperature of which it is intended to sense. This can occur for example because an installer makes a simple error on installing for example a damper system. The error could be as simple as a failure to mount a switch assembly correctly on for example a duct.

SUMMARY OF THE INVENTION

According to the present invention, there is provided a thermally-actuated switch assembly comprising a housing which in use is mounted on a support in a pre-determined orientation, a first switch carried by the housing, the first switch being arranged such that it is actuated if the temperature to which it is exposed exceeds a pre-determined threshold, and a second switch carried by the housing, the second switch being arranged such that it is actuated if the housing is mounted on the support in the predetermined orientation, and the first and second switches being connected to an output and arranged such that the output indicates an alarm condition if either the first switch is actuated or the second switch is not actuated.

The first switch may be a fuse which defines an open circuit if the pre-determined temperature is exceeded, or any other heat-sensitive component an electrical characteristic of which changes if the predetermined temperature is exceeded. The second switch may be connected in series with the first switch. The second switch defines a closed circuit if the housing is mounted in the pre-determined orientation. The second switch may comprise an actuator button which is depressed when the actuator housing is mounted in the pre-determined orientation.

Alternatively, the housing may comprise first and second sections, at least one fastener adapted to secure the housing to the support in the predetermined orientation such that two sections are held together, and means for applying a biasing force between the sections such that if the sections are not held together they move part, wherein the second switch is arranged to be actuated when the sections are held together and not actuated when the sections are moved apart by the biasing means. Preferably, the second switch comprises first contacts mounted on the first housing section and second contacts mounted on the second housing section, the first and second contacts being interengaged when the sections are held together and separated when the sections are moved apart by the biasing means. Each fastener may extend through and be retained in engagement with both the housing sections so as to limit the maximum spacing between the sections.

A switch assembly in accordance with the present invention may be used to control for example a damper arranged to either close or open a duct in the event of an excess temperature being sensed. If an installer fails to mount the switch assembly in an appropriate way on for example a duct to which the damper is connected, for example by simply leaving the switch assembly unattached to the duct, the second switch indicates an alarm condition. Thus the installation error which resulted in the switch assembly not being correctly located is indicated and therefore the overall system performance in the conditions for which the damper was designed will be achieved in a fail-safe manner.

BRIEF DESCRIPTION OF THE DRAWINGS

An embodiment of the present invention will now be described, by way of example with reference to the accompanying drawings, in which.

DETAILED DESCRIPTION OF INVENTION

Figure 1:
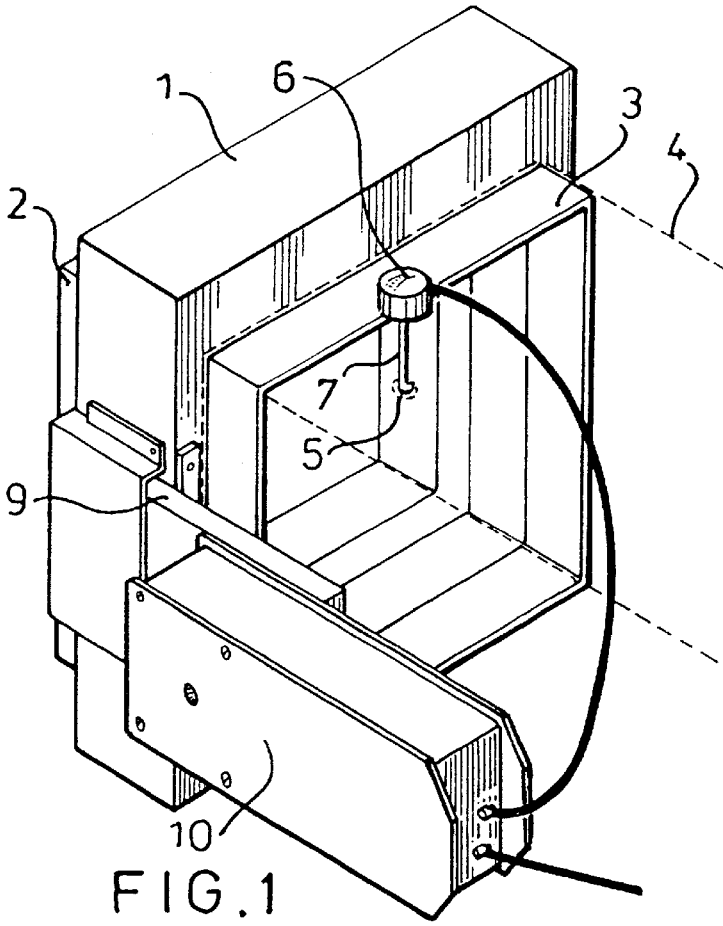
FIG. 1 is a schematic perspective view of a damper assembly which may be controlled by a switch assembly in accordance with the present invention.

Referring to FIG. 1, the illustrated damper comprises a casing 1 supporting axially aligned spigots 2 and 3 to each of which square section ducts will in use be connected. The outline of one such duct is indicated by broken lines 4. An aperture in that duct is also shown by a broken line 5. A switch assembly 6 in accordance with the present invention is shown located above the aperture 5. When fully installed a probe 7 extending from a housing of the switch assembly will be inserted through the aperture 5 so as to project within the duct 4. A damper of the type illustrated in FIG. 1 may be obtained from Actionair Equipment Limited, of Whitstable, Kent, England.

Figure 2:
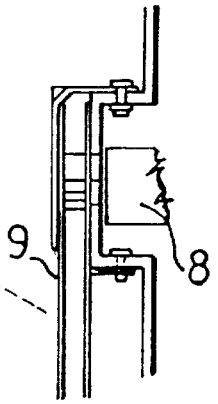
FIG. 2 is a section through a portion of the assembly of FIG. 1.

The casing 1 houses a series of parallel horizontally extending damper blades 8 one of which is shown in the horizontal section of FIG. 2. The damper blades are omitted from FIG. 1 to clarify the general structure of the assembly. The damper blades can be held in the open position as shown in FIG. 2 or rotated through approximately 90 degrees to a position in which each of the blades extends transversely with respect to the aperture defined by the casing 1, adjacent blades overlapping so as to effectively close the opening defined by the casing 1. The blades 8 are mechanically coupled to a mechanical drive arrangement housed within a casing 9 on which an actuator casing 10 is supported. The actuator incorporates a spring return mechanism of known type which is effective to rotate the blades 8 through 90 degrees from the position shown in FIG. 2 in the event of a power supply to the actuator being interrupted. Such actuator and damper blade spring-retuni mechanisms are well known, for example the BF230-T actuator available from Belimo. Given that such actuator assemblies are well known, they will not be further described here.

Figure 3:
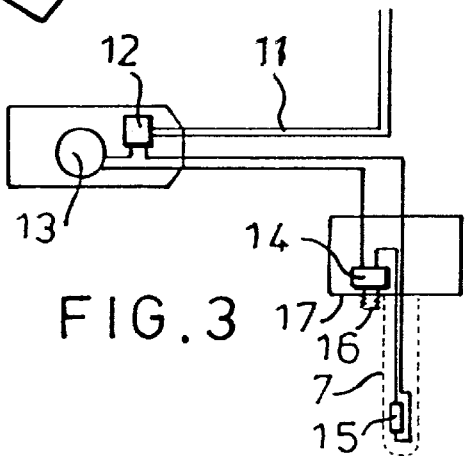
FIG. 3 illustrates the control circuit of the arrangement shown in FIG. 1.

FIG. 3 illustrates the circuit diagram of the arrangement illustrated in FIG. 1. Mains power is delivered via cable 11 to a transformer 12. An electrical motor 13 is connected in series with a first switch 14 and a thermally actuated fuse 15 across the output of a transformer 12. In a conventional system, the switch 14 would be omitted, and accordingly the power supply to the motor 13 would only be interrupted if the fuse 15 was ruptured as the result of for example being exposed to a temperature above a pre-determined limit. In the illustrated arrangement which is in accordance with the invention however the switch 14 must be in a closed-circuit condition for the mains supply to the motor 13 to be maintained. Given that the damper blades 8 will be moved from the position shown in FIG. 2 if the electrical supply to the motor 13 is interrupted, it will therefore be appreciated that both the switch 14 and the fuse 15 must define closed circuits if the damper blades are to be maintained in the open condition.

The switch 14 is provided with an actuator button 16 which projects from a housing of the switch assembly 6. The button 16 projects from a surface 17 defined by the switch assembly. The probe 7 into which the fuse 15 is incorporated also projects from the surface 17. If the switch assembly 6 is mounted on the duct 4 of FIG. 1 with the probe 7 extending through the aperture 5 and the surface 17 of the switch assembly housing from which the probe 7 projects bearing against the surface of the duct 4, the button 16 of the switch 14 is depressed. In that condition, the switch 14 defines a closed circuit and therefore it does not interrupt the electrical supply to the motor 13. If however the switch assembly 6 is either not correctly fitted to the duct 4, or over time is displaced form the position in which it was originally correctly fitted as the result of for example vibration, the surface 17 of the switch assembly housing will no longer be secured against the surface of the duct 4 and as a result the button 16 will move to the position shown in FIG. 3. In those circumstances the switch 14 goes open circuit, thereby interrupting the electrical supply to the motor 13. Thus the damper will be closed if either the fuse 15 is ruptured or the switch 14 goes open circuit as a result of a failure to correctly secure the switch assembly housing to the duct 4.

Referring to FIGS. 4 to 7, an alternative switch assembly to that described with reference to FIGS. 1 to 3 is illustrated. This alternative assembly comprises a housing made up of a base section 18 and a cover section 19. A probe 220 projects from an underside 21 of the base section 18 and supports at its tip a sensor 22 which houses a thermally responsive device 23 such as a fuse which will go open circuit if the temperature to which the sensor is exposed exceeds a predetermined threshold. The device 23 is connected to a pair of socket connectors 24 each of which is carried by the base section 18.

The cover 19 carries a pair of pins 25 which are connected to a lead 26 which enables the assembly to be electrically connected to associated circuitry. The cover 19 and the base 18 are interengaged by a pair of captive screws 27 which extend through respective openings in the cover 19 and the base 18. The ends of the fasteners 27 which project beyond the under surface 21 of the base 18 carry retaining washers (not shown) which prevent the fasteners 27 from being pulled out of engagement with the base 18. Thus the maximum spacing between the base 18 and the cover 19 is determined by the length of the fasteners 27 between the fastener heads and the retaining washers.

Figure 5:
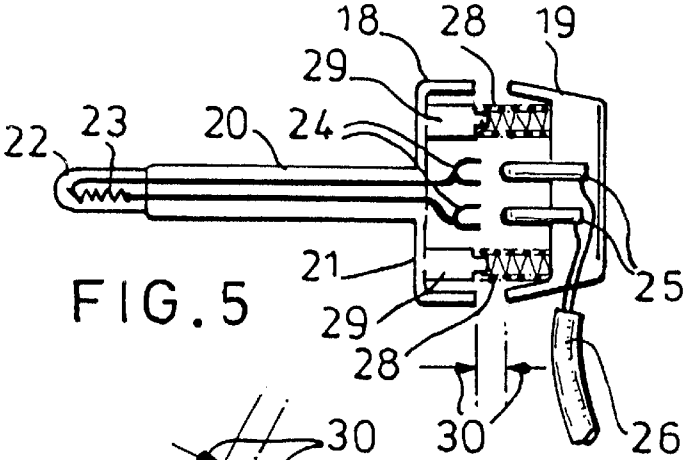
FIG. 5 is a cut-away view of the switch assembly of FIG. 4.
Figure 4:
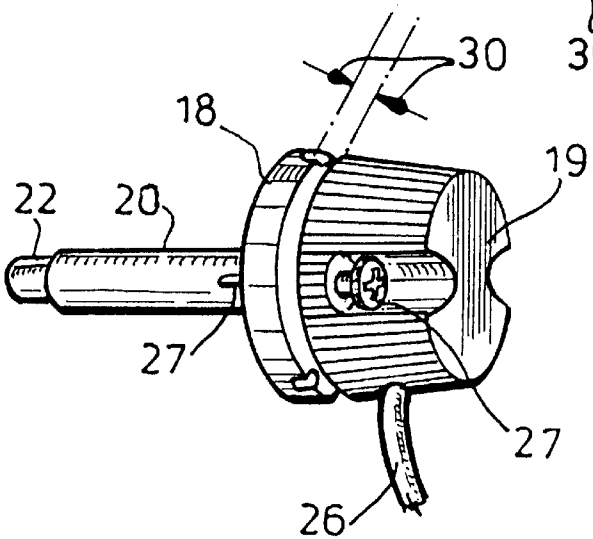
FIG. 4 is a perspective view of an alternative switch assembly in accordance with the present invention.

A set of four springs 28 are supported on posts 29 projecting from the base section 18 of the housing. The springs 28 bear against the underside surface of the cover 19 and thus bias the housing sections 18 and 19 apart. If for example the switch assembly is simply left unattached to any associated surface, the housing sections 18 and 19 will move apart to the extent permitted by the captive fasteners 27. As a result a spacing indicated by the spacing between lines 30 will be established between the two housing sections. In that configuration the pins 25 will be spaced from the sockets 24 as shown in FIG. 5. Any electrical signals on the cable 26 will accordingly be exactly the same as would appear in the event of the sensing device 23 going open circuit.

Figure 7:
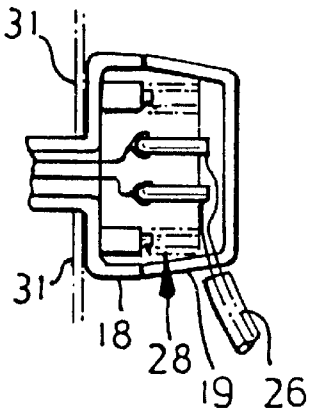
FIG. 7 is a cut-away view of part of the assembly shown in FIG. 5 after the assembly has been mounted on a duct.
Figure 6:
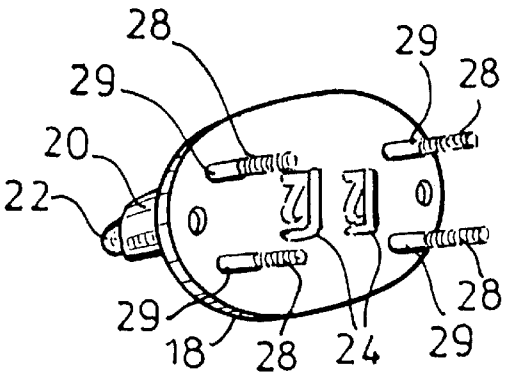
FIG. 6 is a perspective view of a base housing section of the switch assembly of FIG. 4.

The illustrated switch assembly is in normal use mounted on a wall 31 of a duct as shown in FIG. 7. Openings (not shown) will be drilled in the wall 31 to receive the fasteners 27. As the fasteners are tightened down, the cover 19 will be pressed down against the bias force presented by the springs 28 until the cover 19 and base 18 are held together as shown in FIG. 7. In that condition, the pins 25 are in engagement with the sockets 24 and thus the cable 26 is in direct contact with the sensing device 23. The switch assembly will go open circuit in this condition only if the sensing device 23 goes open circuit. Thus if a fitter fails to tighten down the fasteners 27 sufficiently, or the fasteners become sufficiently loose due to for example vibration for the pins 25 to be pushed out of the sockets 24 by the springs 28, the output from the switching assembly will be identical to that which indicates the ensing device 23 going open circuit.

It will be appreciated that although the described embodiments of the invention are arranged such that a duct is closed in the event of a fault condition being indicated, a damper assembly could be arranged to open only in the event of an alarm condition being indicated. The term "alarm condition" is used to indicate a condition in which either the thermally actuated switch such as fuse 15 of FIG. 3 or the mechanically actuated switch 14 of FIG. 3 is open circuit. It will of course be appreciated that the two switches need not be connected in series but could be connected in an alternative configuration provided associated circuitry indicates an alarm condition in the event of either of the switches sensing a condition other than normal.

What is claimed is:

1. A thermally-actuated switch assembly comprising a housing which in use is mounted on a support in a predetermined orientation, a first switch carried by the housing, the first switch being arranged such that it is actuated if the temperature to which it is exposed exceeds a pre-determined threshold, and a second switch carried by the housing, the second switch being arranged such that it is actuated if the housing is mounted on the support in the predetermined orientation, and the first and second switches being connected to an output and arranged such that the output indicates an alarm condition if either the first switch is actuated or the second switch is not actuated.

2. A switch assembly according to claim 1, wherein the first switch is a fuse which defines an open circuit if the predetermined temperature is exceeded, and the second switch is connected in series with the fuse, the second switch defining a closed circuit if the housing is mounted in the pre-determined orientation.

3. A switch assembly according to claim 2, wherein the second switch is actuated by an actuator button which is biased relative to the housing from a first position in which the second switch is actuated to a second position in which the second switch is not actuated and the actuator button projects from the housing, the actuator button being positioned on the housing such that mounting the housing on the support causes the actuator button to be moved to the actuated first position.

4. A switch assembly according to claim 3, wherein the support comprises a duct on which the housing is mounted, and the output is connected to a duct closure device which is closed if the alarm condition is indicated.

5. A switch assembly according to claim 2, wherein the housing comprises first and second sections, at least one fastener adapted to secure the housing to the support in the predetermined orientation such that two sections are held together, and means for applying a biasing force between the sections such that if the sections are not held together they move apart, wherein the second switch is arranged to be actuated when the sections are held together and not actuated when the sections are moved apart by the biasing means.

6. A switch assembly according to claim 5, wherein the second switch comprises first contacts mounted on the first housing section and second contacts mounted on the second housing section, the first and second contacts being interengaged when the sections are held together and separated when the sections are moved apart by the biasing means.

7. A switch assembly according to claim 6, wherein each fastener extends through and is retained in engagement with both the housing sections so as to limit the maximum spacing between the sections.

8. A switch assembly according to claim 7, wherein the support comprises a duct on which the housing is mounted, and the output is connected to a duct closure device which is closed if the alarm condition is indicated.

9. A switch assembly according to claim 5, wherein the support comprises a duct on which the housing is mounted, and the output is connected to a duct closure device which is closed if the alarm condition is indicated.

10. A switch assembly according to claim 4, wherein each fastener extends through and is retained in engagement with both the housing sections so as to limit the maximum spacing between the sections.

11. A switch assembly according to claim 4, wherein the support comprises a duct on which the housing is mounted, and the output is connected to a duct closure device which is closed if the alarm condition is indicated.

12. A switch assembly according to claim 2, wherein the support comprises a duct on which the housing is mounted, and the output is connected to a duct closure device which is closed if the alarm condition is indicated.

13. A switch assembly according to claim 1, wherein the second switch is actuated by an actuator button which is biased relative to the housing from a first position in which the second switch is actuated to a second position in which the second switch is not actuated and the actuator button projects from the housing, the actuator button being positioned on the housing such that mounting the housing on the support causes the actuator button to be moved to the actuated first position.

14. A switch assembly according to claim 1, wherein the housing comprises first and second sections, at least one fastener adapted to secure the housing to the support in the predetermined orientation such that two sections are held together, and means for applying a biasing force between the sections such that if the sections are not held together they move apart, wherein the second switch is arranged to be actuated when the sections are held together and not actuated when the sections are moved apart by the biasing means.

15. A switch assembly according to claim 14, wherein the second switch comprises first contacts mounted on the first housing section and second contacts mounted on the second housing section, the first and second contacts being interengaged when the sections are held together and separated when the sections are moved apart by the biasing means.

16. A switch assembly according to claim 15, wherein each fastener extends through and is retained in engagement with the housing sections so as to limit the maximum spacing between the sections.

17. A switch assembly according to claim 14, wherein each fastener extends through and is retained in engagement with both the housing sections so as to limit the maximum spacing between the sections.

18. A switch assembly according to claim 1, wherein the support comprises a duct on which the housing is mounted, and the output is connected to a duct closure devices which is closed if the alarm condition is indicated.

* * * * *